US011117416B2

(12) United States Patent
Bänziger et al.

(10) Patent No.: US 11,117,416 B2
(45) Date of Patent: Sep. 14, 2021

(54) FLATBED EMBOSSED-PRINTING MACHINE AND EMBOSSING PLATE

(71) Applicant: Gietz AG, Gossau (CH)

(72) Inventors: Heinz Bänziger, Gossau (CH); Manfred Rösli, Herisau (CH)

(73) Assignee: Gietz AG, Gossau (CH)

( * ) Notice: Subject to any disclaimer, the term of this patent is extended or adjusted under 35 U.S.C. 154(b) by 274 days.

(21) Appl. No.: 15/752,267

(22) PCT Filed: Aug. 15, 2016

(86) PCT No.: PCT/CH2016/000108
§ 371 (c)(1),
(2) Date: Feb. 20, 2018

(87) PCT Pub. No.: WO2017/031603
PCT Pub. Date: Mar. 2, 2017

(65) Prior Publication Data

US 2018/0229543 A1 Aug. 16, 2018

(30) Foreign Application Priority Data

Aug. 21, 2015 (CH) ..... 01 211/15

(51) Int. Cl.
*B21D 37/16* (2006.01)
*B44B 5/02* (2006.01)
(Continued)

(52) U.S. Cl.
CPC ..... *B44B 5/028* (2013.01); *B21D 22/02* (2013.01); *B21D 37/16* (2013.01); *B41F 19/064* (2013.01);
(Continued)

(58) Field of Classification Search
CPC ..... B44B 5/028; B21D 22/02; B21D 37/16; B41F 19/064; B41F 33/00; H05B 6/14;
(Continued)

(56) References Cited

U.S. PATENT DOCUMENTS 1,909,844 A 5/1933 Brenner
2,558,354 A 6/1951 Gottscho
(Continued)

FOREIGN PATENT DOCUMENTS

DE 4241210 A1 6/1994
EP 1201427 A2 5/2002
(Continued)

OTHER PUBLICATIONS

EPO Machine translation in English of EP 2664458.*
(Continued)

*Primary Examiner* — Debra M Sullivan
(74) *Attorney, Agent, or Firm* — Oppedahl Patent Law Firm LLC

(57) ABSTRACT

The invention relates to a flat bed embossing machine (1) comprising a tool plate (20) with a tool side (36) for receiving at least one embossing tool and with a tool plate rear side (35) which lies opposite the tool side (36), further a base plate (10) with a tool plate side (12) which faces the tool plate rear side (35) and with a base plate rear side (11) which is lies opposite the tool plate side (12), for transmitting an embossing force which is exerted upon the tool plate (20), between the tool plate side (12) and the base plate rear side (11), as well as an induction heating appliance (3) for heating the at least one embossing tool (23). The induction heating appliance (3) comprises an inductor (16), the design of which and its arrangement between the tool plate side (12) and the base plate rear side (11) being such that a magnetic alternating field (19) which on the tool plate side (12)
(Continued)

reaches beyond the base plate (19) and is for the inductive heating of an inductively heatable tool plate (20) can be produced beyond of the tool plate side (12) and outside the base plate (10).

17 Claims, 6 Drawing Sheets

(51) Int. Cl.
*B41F 19/06* (2006.01)
*B21D 22/02* (2006.01)
*B41F 33/00* (2006.01)
*H05B 6/14* (2006.01)

(52) U.S. Cl.
CPC ..... *B41F 33/00* (2013.01); *H05B 6/14* (2013.01); *B41P 2219/31* (2013.01)

(58) Field of Classification Search
CPC ... B41P 2219/31; C21D 1/42; B29C 44/5627; B29C 59/02; B30B 15/34
USPC ..... 72/342.8
See application file for complete search history.

(56) References Cited

U.S. PATENT DOCUMENTS

| | | | | |
|---|---|---|---|---|
| 2,740,352 | A | 4/1956 | Kingsley | |
| 3,608,488 | A * | 9/1971 | Levine | B41M 1/24 347/112 |
| 4,130,050 | A | 12/1978 | Graf | |
| 4,852,382 | A | 8/1989 | Gietz et al. | |
| 5,718,057 | A | 2/1998 | Rosli et al. | |
| 5,746,122 | A | 5/1998 | Gietz et al. | |
| 5,979,308 | A * | 11/1999 | Kagi | B41F 19/068 101/27 |
| 7,424,903 | B2 | 9/2008 | Kagi et al. | |
| 8,196,307 | B2 | 6/2012 | Kagi et al. | |
| 8,459,323 | B2 | 6/2013 | Brendle | |
| 2007/0056451 | A1 | 3/2007 | Klann | |
| 2007/0158871 | A1 | 7/2007 | Akamatsu | |
| 2007/0251940 | A1 | 11/2007 | Hennessey | |
| 2008/0196607 | A1* | 8/2008 | Rinko | B29C 59/02 101/32 |
| 2011/0207328 | A1* | 8/2011 | Speakman | H01L 51/0011 438/694 |
| 2015/0343678 | A1 | 12/2015 | Ito | |
| 2018/0229543 | A1* | 8/2018 | Banziger | B44B 5/028 |

FOREIGN PATENT DOCUMENTS

| | | | |
|---|---|---|---|
| EP | 2664458 | A2 | 11/2013 |
| GB | 867287 | A | 5/1961 |
| JP | 2005-310286 | A | 11/2005 |
| JP | 2006-035506 | A | 2/2006 |
| JP | 2006-256078 | A | 9/2006 |
| JP | 2014-091280 | A | 5/2014 |
| WO | WO 2005/075184 | A1 | 8/2005 |
| WO | 2009143644 | A1 | 12/2009 |
| WO | WO 2014/104963 | A1 | 7/2014 |

OTHER PUBLICATIONS

English translation of Written Opinion of the International Search Authority in international application No. PCT/CH2016/000108, dated Mar. 15, 2017.
English translation of International Search Report in international application No. PCT/CH2016/000108, dated Mar. 15, 2017.

* cited by examiner

FLATBED EMBOSSED-PRINTING MACHINE AND EMBOSSING PLATE

The invention relates to the field of flat bed embossing machine and concerns a flat bed embossing machine as well as a tool plate for a flat bed embossing machine, according to the preamble of claims 1 and 18.

BACKGROUND

Amongst other things, flat bed embossing machines, also called flat bed stamping machines or flat foil printing presses are used for embossed foil printing, hologram transfer, blind embossing, micro-embossing as well as structure embossing.

Concerning embossed foil printing, an embossing foil is "pressed" onto a flat material with the help of an embossing tool and as a rule amid the effect of heat. The transferred foil herein lies in one plane with the flat material. A hardly noticeable to significant embossing of the flat material results, depending on the embossing tool, the pressing pressure and the flat material. Herein, the flat material is the carrier of the embossing or print embossing.

Flat bed embossing machines represent a special design manner of embossing machines and differ from other embossing machines amongst other things by a flat bed press with a press head and press bed.

Here, the press head which receives the tool plate corresponds to the press upper part. It represents the counterpiece to the press bed, the press lower part which receives the back-pressure plate.

Flat bed embossing machines are characterised by a high embossing performance and embossing quality. It is for this reason that flat bed embossing machines are also suitable for particularly demanding embossing printing tasks such as the manufacture of banknotes.

Flat bed embossing machines in particular permit a positioning of the flat material in the embossing zone with register accuracy as well as the application of highly sensitive embossing foils.

Moreover, flat bed embossing machines are also characterised by optimal operating conditions such as uniform temperature and pressure conditions in the region of the embossing zone.

Typical flat bed embossing machines are known e.g. from EP 0858 888 and WO 2009/14644.

Concerning embossed printing methods such as embossed foil printing, the embossing tools are heated to an operating temperature e.g. to 150 to 200° C. by way of a heating appliance before the beginning of the embossing process. The operating temperature is selected for example such that during the embossing procedure, an embossing foil with a transfer layer of plastic is activated, in particular melted, by the heat of the embossing tool for the purpose of creating a material-fit connection with the flat material.

On the one hand, it is important to heat the embossing tools to the optimal operating temperature and maintain it at this temperature during the operation of the machine, for a flawless embossing and for achieving the highest embossing quality. On the other hand, it is also important for the operating temperature to be the same over all embossing tools and for it to also be kept the same during the operation of the machine. Only in this manner are the same embossing conditions over the complete tool plate ensured, so that no differences in quality occur in the embossed flat material.

However, concerning the subject of embossing quality, the heating procedure is not only of significance with regard to the setting of the optimal operating temperature of the embossing tools. A thermal expansion of heated machine parts also takes place with the heating-up of the machine. This thermal expansion already needs to be taken into account beforehand on setting the embossing geometries. Only in such a manner can a precise embossing be achieved. As a result, it is extremely important for the machine to be operated at that optimal operating temperature, to which the embossing geometry has previously been set.

Flat bed embossing machines with heating appliances which are for heating embossing tools and which are designed as electrical resistance heaters are known from the state of the art. The heating of the embossing tools to the operating temperature by way of such resistance heaters however take up a lot of time. It is thus not uncommon for several hours, e.g. 5 to 6 hours to pass from the point in time of connecting the heating appliance to reaching the optimal operating temperature.

This is particularly due to the fact that the thermal energy must be led by way of thermal conduction from the heating resistance of the resistance heater firstly into the tool plate and via this into the embossing tools which are assembled on the tool plate.

Moreover, with regard to conventional, electrical resistance heaters, it is also particularly the remaining press head or parts thereof which are heated due to the thermal conduction taking place in all directions.

However, the components of the press head which are now likewise involuntarily heated are also subject to thermal expansion which in turn influences the embossing accuracy. For this reason, the embossing process can only be started when the press head is also heated to a stable operating temperature. This is accordingly taken into account beforehand with regard to the embossing settings.

The stable operating temperature of the complete machine to the extent that no further thermal expansion of individual machine parts occurs is therefore achieved only very slowly. This results in the long heating-up time which is mentioned above.

In endeavouring on the one hand to increase the productivity and one the other hand to reduce the operating costs, is the object of the present invention to suggest a flat bed embossing machine with a heating appliance and characterised by a significantly shortened heating-up time.

The flat bed embossing machine should moreover be suitable for demanding printing/embossing tasks and have no shortcomings in the quality of the embossed products vis-à-vis a conventional flat bed embossing machine.

A shortened heating-up time in particularly very generally leads to shorter setting/adjusting and reconfiguration times and therefore to shorter standstills of the flat bed embossing machine.

A further object of the present invention is to suggest a flat bed embossing machine with a heating appliance which is characterised by reduced energy costs.

A further object of the present invention is to suggest a flat bed embossing machine with a heating appliance which is characterised by a precise, delay-free regulation (closed-loop control) of the tool temperature. The heating appliance and/or the temperature regulation should in particular simplify the heating of the embossing tools to an operating temperature which is the same with all embossing tools, as well as the maintaining of this operating temperature.

A further object of the present invention is to suggest a flat bed embossing machine with a heating appliance, by way of which the embossing tools can be heated in an as targeted as possible manner, without further machine parts being unnecessarily heated.

SUMMARY OF THE INVENTION

The objects which are mentioned above are achieved by the features of the independent claims 1 and 18. Particular further developments and embodiments of the invention result from the dependent claims, the description and the drawings.

The flat bed embossing machine therefore comprises:

- a tool plate, also called cliché plate, with a tool side, also called cliché side, for receiving at least one embossing tool, also called cliché, and with a tool plate rear side which lies opposite the tool side;
- a base plate with a tool plate side which faces the rear side of the tool plate and with a base plate rear side which is opposite the tool plate side and is for transmitting an embossing force which is exerted upon the tool plate, between the tool plate side and the base plate rear side; and
- a heating appliance for heating the at least one embossing tool.

The tool plate with the embossing tool and the base plate in particular are part of a press head. Herein, the base plate with its plate rear side faces the press head. The base plate is fastened to the press head in particular via the plate rear side.

The press head in particular is arranged above a press bed also called printing table, which comprises a back-pressure plate.

A flat material and an embossing-printing foil web are inserted between the tool plate and back-pressure plate which are distanced to one another, for carrying out the embossing procedure. The embossing pressure is effected by way of leading together the tool plate with the embossing tool and the back-pressure plate whilst applying a pressing pressure.

According to a common embodiment of a flat bed embossing machine, the back-pressure plate is moved towards the stationary tool plate when carrying out the embossing procedure. The press pressure is consequently exerted from the back-pressure plate or press bed onto the tool plate or press head. Concerning this procedure, the press pressure is transmitted from the tool plate into the remaining press head via the base plate.

Since the flat bed embossing machine needs to be reconfigurable with regard to the embossing tools, the tool plate is releasably fastened to the press head in particular via a holder or mounting. For exchanging the embossing tools, the tool plate is released from the press head and is moved e.g. via a guiding device into a configuring (setting-up) position, in which the tool plate can be equipped with embossing tools.

After the refitting or reconfiguration has been effected, the tool plate is moved back again into its operating position via the guiding device and is fastened to the press head by way of the holder.

Concerning this procedure, the base plate in particular remains stationary on the press head. However, the base plate can likewise be releasably fastened to the press head.

The heating appliance here is an induction heating appliance with an inductor. In an induction heating appliance, a magnetic alternating field is produced by way of an inductor, through which alternating current flows, said alternating field inducing eddy flows and possibly also re-magnetisation losses in an electrically conductive body which is to be heated and effecting a heating of the body. The inductor is therefore an inductive heating means.

The design of the inductor and its arrangement between the tool plate side and the base plate rear side is such that a magnetic alternating field which at the tool plate side reaches beyond the base plate and is for the inductive heating of an inductively heatable tool plate can be produced at the other side of the tool plate side and outside the base plate.

The magnetic alternating field in particular reaches into the tool plate.

The induction heating appliance in particular comprises a device for providing alternating current at the required frequency. The device in particular can comprise a power unit, e.g. with a frequency converter which provides the electrical power at the necessary frequency.

The heat therefore arises directly in the body itself which is to be heated and consequently does not need to be transferred onto this by way of thermal conduction. Accordingly, the thermal power is easily controllable and the efficiency is very high, particularly with ferromagnetic materials.

The induction heating appliance is now designed to inductively heat the tool plate, wherein a magnetic alternating field is applied in the tool plate in a targeted manner by way of the inductor.

The embossing tools are indirectly heated via the tool plate by way of thermal conduction.

The induction heating appliance can also be designed to additionally inductively heat the embossing tools which are assembled on the tool plate. In this case, the magnetic alternating field is also applied in the embossing tools by way of the inductor.

The induction heating appliance can hence inductively heat the embossing tools as well as the tool plate, possibly with different efficiencies.

However, the embossing tools can be manufactured of different materials such as brass, steel, magnesium or aluminium, depending on the field of application, i.e. depending on the materials to be embossed as well as depending on the prevailing embossing pressures and embossing temperatures. Some of these metals do not have particularly good inductive characteristics, so that the embossing tools can only be heated comparatively poorly, i.e. in particular with a poor efficiency, or not at all.

A direct, inductive heating of the embossing tools without likewise inductively heating the tool plate is not therefore at the forefront. This is also due to the fact that the mass of the tool plate must likewise be heated for a stable operating temperature. This is effected more quickly and efficiency if the tool plate is inductively heated in a direct manner and not indirectly by way of thermal conduction via the embossing tools.

Since the heat in the tool plate is not produced until interaction between the tool plate and the magnetic alternating field, the tool plate can also be considered as part of the induction heating appliance.

Apart from the higher efficiency, inductive heating also has the advantage that the inductive effect can be effected through non-conductive materials such as plastic, without the non-conducting materials being inductively heated. Non-conductive bodies which do not negatively influence the heating procedure can therefore be arranged between the inductor and the heating zone, in which the inductive heating takes place.

According to the invention, the tool plate forms a heating zone of an inductively heatable material on interaction with a magnetic alternating field.

The heating zone in the tool plate in particular consists of a ferromagnetic material or comprises such. The complete tool plate can also consist of a ferromagnetic material or comprise this. In particular, the tool plate can consist of ductile cast iron, in particular GGG40.

The tool plate typically has a width transverse to the process direction of 70 to 110 cm and a length in the process direction of 50 to 80 cm. The height or thickness of the tool plate is typically 15 to 20 mm.

In particular, the tool plate is designed as one piece.

According to a further development of the invention, the tool plate forms a continuous, i.e. consistent base region in the region of the tool plate rear side. The height of the base region can e.g. be 1 to 5 mm, in particular 1 to 3 mm. Continuous or consistent means that the base region runs over the entire surface of the tool plate without interruption, i.e. has no openings.

The heating zone which is formed in the tool plate thereby in particular comprises the continuous base region. A uniform and rapid transverse distribution of the thermal energy which is inductively produced in the base region takes place thanks to the continuous base region.

The induction heating appliance is accordingly designed such that the magnetic alternating field is directed into the tool plate and in particular into its base region. The eddy currents which are produced in the tool plate ensure a rapid and uniform heating of this.

According to a further development of the tool plate, this comprises a plurality of deepenings which are open towards the tool side and towards the plate rear side are taken over by the continuous base region. I.e. the deepenings are not designed in a continuous manner between the tool side and the plate rear side, but are delimited by the base region. The deepenings run transversely to the support surfaces which are formed by the tool side and the plate rear side.

The deepenings serve as a fastening aid for the embossing tools which are releasably fastened on the tool side. They consequently form a fastening zone in the tool plate.

The deepenings can be incorporated into the tool plate by way of drilling or milling. In particular, the deepenings are designed as bores in the tool plate. In particular, the deepenings are blind holes.

However, it is also conceivable for the tool plate to be designed of several parts and to comprise e.g. a carrier plate with continuous holes, as well as a base plate which bears on its rear side. The base plate forms the continuous base region. The base plate is of a ferromagnetic material or comprises this. The base plate can be connected to the carrier plate via a material-fit connection such as soldering or welding. A mechanical connection is also conceivable.

A particular embodiment of such a tool plate is the honeycomb mount/base which is known from the state of the art. However, the present tool plate differs from the known honeycomb mount in that the deepenings in the tool plate are not designed as holes which are continuous from the tool side to the plate rear side, but in contrast are closed to the plate rear side and end in the transition to the continuous base region.

In particular, the inductor is designed as a wound electrical conductor. Its curvatures are arranged in particular in a plane parallel to the support surface which is formed on the tool plate side. In particular, the inductor can be a flat coil, such as a spiral flat coil.

The base plate forms a plane support surface on the tool plate side. In particular, the support surface is continuous, possibly with the exception of an opening for a temperature sensor.

The base plate forms a plane support surface on its rear side. The support surface in particular is not designed in a continuous manner. The support surface can be interrupted in particular by deepenings or recesses for receiving the inductor or field conducting elements.

In particular, the initially mentioned embossing pressures can be transmitted between the tool plate and the remaining press head via the mentioned support surfaces.

According to a further development of the invention, the base plate receives the inductor. This means that the inductor is recessed into the base plate. "Recessed" in particular means that the inductor does not extend beyond the support surface of the rear side.

The base plate and the inductor are therefore part of a heating module.

The inductor can be recessed for example into deepenings or recesses of the base plate. The deepenings or recesses can e.g. be slot-like.

The deepenings or recesses are open towards the base plate rear side.

The base plate in particular comprises a base region towards the tool plate side. The deepenings or recesses for the inductor are delimited towards the tool plate side in particular by the base region.

In particular, the base region is continuous, possibly with the exception of an opening for a temperature sensor.

The inductor for example can be moulded or bonded in the deepenings or recesses of the base plate.

However, it is also possible for the inductor to already be integrated into the base plate on manufacturing the base plate. In this case, the inductor is encompassed by the carrier material of the base plate on all sides. The tool side and the rear side both have a continuous support surface, possibly with the exception of an opening for a temperature sensor.

According to a further development of the invention, field conducting elements with ferrimagnetic characteristics are arranged between the inductor and the base plate rear side. The field conducting elements serve for deflecting and possibly also for modulating the magnetic alternating field. With this, on the one hand one is to succeed in the magnetic alternating field being optimally introduced into the tool plate and on the other hand of penetrating as little as possible into the remaining press head. An undesirable heating of the remaining press head can be prevented or at least reduced by way of such a measure.

The field conducting elements can be e.g. ferrite bodies.

According to a further development of the invention, the base plate receives the field conducting elements. This means that the field conducting elements are recessed into the base plate. "Recessed" in particular means that the field conducting elements do not extend beyond the support surface of the plate rear side.

The field conducting elements can be part of the heating module which is mentioned above.

The field conducting elements can be recessed for example in deepenings or recesses of the base plate. As mentioned above as an alternative variant, the field conducting elements can also be integrated together with the inductor into the base plate on manufacture of this.

According to a further development of the invention, a flat shielding element with at least one layer of an electrically conductive material is arranged on the base plate rear side. The shielding element extensively covers the support surface of the base plate rear side, in particular over the whole surface. In particular, the shielding element bears on the support surface.

The shielding element is not or is only poorly inductively heatable. In this manner, the shielding element at least partly shields the remaining press head from the magnetic alternating field in the rear-side region of the base plate, without the shielding element itself likewise being significantly heated. This measure contributes to the prevention of the heating of the remaining press head or at least to the reduction of this heating.

In particular, the shielding element is of an electrically well conductive metal such as aluminium or copper or comprises this. The shielding element in particular can be designed as a plate or metal sheet.

In particular, the base plate consists of a carrier material which is electrically non-conductive. In particular, the carrier material of the base plate is designed in a thermally insulating manner. The thermal energy which is thus produced in the tool plate cannot penetrate through the base plate via the base plate rear side into the remaining press head on account of thermal conduction. The base plate therefore thermally insulates the press head which is arranged above, with respect to the tool plate which is arranged beneath.

The carrier material is further characterised in particular by its shape stability, mechanical strength, in particular compressive strength as well as temperature robustness. Compressive strength means that the base plate can accommodate pressing pressures as occur on embossing or can transmit them between the tool plate and the remaining press head, without herein becoming structurally damaged, in particular deformed.

The carrier material can be resistant to pressures for example of up to 600 $N/mm^2$ and be applied accordingly. The carrier material can be resistant to temperatures for example of up to 250° and be applied accordingly.

The carrier material is preferably a plastic, in particular a technical plastic or contains such, e.g. in the form of a matrix. In particular, the carrier material can be a fibre-reinforced plastic. In particular, the reinforcement fibres are glass fibres.

The mentioned technical plastic is characterised in particular by its high application temperatures and high compressive strengths.

The fibres of the fibre-reinforced plastic can be present as a textile sheet formation such as fibre mats. In particular, the textile sheet formation can be short-fibre mats or fine fabric or roving fabric.

In particular, the plastic which forms the matrix in the presence of reinforcement fibres is a duroplastic which is based e.g. on a resin system. In particular, the plastic can be of an epoxy resin, polyester resin, copolymer resin, polyimide resin or silicone resin or comprise these.

On operation, the base plate via its tool side bears on the tool plate in particular in an extensive manner. Furthermore, the base plate via its plate rear side bears on the remaining press head in particular in an extensive manner. In this manner, pressing forces can be transmitted between the base plate and the tool plate or between the base plate and the press head via the support surfaces which face one another.

The support surfaces of the base plate and of the tool plate or of the base plate and of the press head, said support surfaces facing one another, can in particular lie in a planar-parallel manner to one another on operation. All four support surfaces preferably run planar-parallel to one another.

The base plate can have a height or thickness of 10 to 30 mm. The tolerance region with regard to the thickness of the base plate in particular lies at only 0.02 to 0.05 mm.

The base plate can have a width of 10 to 30 cm and a length of 20 to 50 cm.

According to a further development of the invention, the flat bed embossing machine comprises a plurality of heating modules which are arranged next to one another over the rear side of the tool plate and are each with at least one base plate and an inductor.

The individual heating modules in particular are individually controllable and as a result are individually operable. Individual surface regions of the tool plate can be individually heated by way of this.

The heating zone of the tool plate can therefore be subdivided over its surfaced extension into individual part-zones (part-heating zones) which are individually heatable.

This is of significance for example if, in the process direction, a front tool plate region which is arranged towards the exit side of the embossing region and/or a rear tool plate region which is arranged towards the entry side of the embossing region undergoes a greater heat loss than e g a middle tool plate region on account of a blowing airflow or generally on account of the proximity to the cooler environment.

A blowing airflow is applied for example with sheet-fed machines at the exit side of the embossing region, and with continuous web machines at the entry side and the exit side of the embossing region, for separating the foil web from the flat material.

Here, what is meant by process direction is that direction, in which on operation the flat material is transported through the embossing region between the embossing tool and the back-pressure plate.

The front or rear region can now be supplied with more heating power than the middle region, in order now, despite this, to ensure a homogenous temperature over the entire surface extension of the tool plate.

The flat bed embossing machine according to this further development in particular comprises several heating modules which are arranged one after the other in the process direction.

The flat bed embossing machine according to this further formation can also comprise several heating modules which are arranged next to one another in the process direction. However, it is also possible for the heating modules, with respect to the process direction, to extend over the complete transverse extension of the tool plate.

Moreover, it is also conceivable for the flat bed embossing machine to comprise several heating modules which arranged successively in the process direction as well as several which are arranged next to one another.

The temperature must be able to be determined in each part-zone for the individual control of the temperature of the individual part zones. For this, each heating mode comprises a device for detecting the temperature in the respective part-zone, in particular a temperature measuring device with at least one temperature sensor, as described hereinafter.

According to the mentioned further development, an individual power unit can be assigned to each inductor of a heating module. However, it is also conceivable for the inductors of the heating modules to be individually supplied with power via a common power unit by way of multiplexers.

According to a preferred further development of the invention, the heating appliance comprises a device for determining or detecting at least one temperature of the tool plate, in particular a temperature in the heating zone of the tool plate. The device can be part of the heating module.

With regard to the surface extension of the tool plate, the temperature is determined in particular at least at one location or in at least one region of the tool plate. In particular, the device can also be designed for determining the temperature at several locations or regions of the tool plate.

If the heating zone comprises a continuous base region of the tool plate, then it is particularly the temperature of the base region which is determined or measured.

According to a further development of the invention, the device which is mentioned above is a temperature measuring device with at least one temperature sensor for measuring a temperature of the tool plate, in particular of the base region. The temperature sensor can be e.g. a Pt100 sensor.

The temperature sensor is attached in particular to a sensor carrier. In particular, the sensor carrier is recessed in a recess in the base plate. The recess comprises an opening towards the tool plate side.

The temperature measuring device is designed such that on operation, the temperature sensor forms a measuring contact with the tool plate, in particular with the base region.

The temperature measuring device can comprise a movement mechanism, via which the temperature sensor is fastened to the base plate in a movable manner relative to the base plate, so that the tool plate e.g. given a reconfiguration procedure, can be moved relative to the base plate without damaging the temperature sensor.

The movement mechanism is designed such that the temperature sensor can be moved by way of the movement mechanism at least between a measuring position, in which the temperature sensor forms a measuring contact with the tool plate in the operating position, and a configuring position which is different to the measuring position and which the temperature sensor assumes on (re-)configuring the tool plate.

The measuring position is designed such that in the operational position, the temperature sensor assumes a physical measuring contact with the tool plate. For this, the temperature sensor in the measuring position in particular is aligned in a flush manner with the support surface of the tool plate side or projects beyond this.

The movement mechanism can comprise a restoring element which is designed to move the temperature sensor by way of a restoring force into one of the two positions, in particular into the configuring position, given a cessation of actuating force which acts directly or indirectly upon the temperature sensor.

According to a first further development of the temperature measuring device, as is shown for example by way of the embodiment example according to FIGS. 8*a* and 8*b*, the configuring position is now designed such that the temperature sensor is arranged in the base plate in a manner distanced to the support surface of the tool plate side. This means that the temperature sensor is retracted into the base plate.

Accordingly, the temperature sensor is movable by way of the movement mechanism towards the tool plate side into the measuring position and from this back into the configuring position.

The movement mechanism can comprise a drive. The drive can be effected e.g. pneumatically or hydraulically. The drive moves the temperature sensor from the configuring position into the measuring position by way of a guide, e.g. by way of a pneumatically or hydraulically exerted actuating force.

The movement mechanism can moreover comprise a restoring element such as a restoring spring (tension spring) which ensures that the temperature sensor is led back from the measuring position into the configuring position by way of the restoring force of the restoring element given the reduction or cessation of the actuating force.

According to a second further development of the temperature measuring device, as is shown for example by way of the embodiment example according to FIG. 9, the configuring position is designed such that the temperature sensor projects beyond the support surface of the tool plate side. This means that the temperature sensor protrudes beyond the base plate.

Accordingly, the temperature sensor is movable via the moment mechanism towards the support surface into the measuring position and away from the base plate out of the measuring position into the configuring position.

The determining of the temperature at the tool plate in particular serves for the regulation of the temperature of the tool plate.

For this, the flat bed embossing machine in particular comprises a device for regulating (closed-loop controlling) the temperature of the tool plate on the basis of temperature values which are detected by the device for determining the temperature. The heating power of the induction heating appliance is herein determined by the regulating device.

The bed embossing machine moreover in particular comprises a foil web guide for guiding the foil web through the embossing region between the embossing tool and the back-pressure plate. The embossing foil can be a metal foil, a plastic foil or a composite foil. The embossing foil can be a picture foil or colour foil.

In particular, the flat bed embossing machine further comprises a transport appliance for the flat material. The transport appliance comprises a feed device for feeding the flat material into the embossing region between the embossing tool and the back-pressure plate, as well as a leading-way device for leading away the flat material out of the embossing region after the effected embossing.

In particular, the flat material is flexible. The flat material e.g. is of paper, cardboard, plastic, metal or a composite thereof. The flat material can be fed in the form of individual sheets (sheet-fed machine) or in the form of a continuous web (continuous web machine).

The present invention has the advantage that the reduced setting and reconfiguration times due to the shorter heating-up time lead to a higher productivity of the flat bed embossing machine. The heating-up time with the flat bed embossing machine according to the invention can thus be reduced to less than one hour.

At the same time, a more precise temperature control is possible thanks to the lower reaction times of the induction heating appliance, by which means the embossing quality can be increased and the rejection rate reduced. The range of demanding embossing tasks can be significantly widened by this.

The induction heating appliance is moreover characterised by a greatly reduced energy consumption, since the thermal energy can be produced directly in the body to be heated and an unnecessary heating of further machine parts does not take place.

DESCRIPTION OF THE DRAWINGS

The subject-matter of the invention is hereinafter explained in more detail by way of embodiment examples which are shown in the accompanying drawings. In each case in a schematic manner are shown in.

Basically, the same parts are provided with the same reference numerals in the figures.

DETAILED DESCRIPTION

Figure 1:
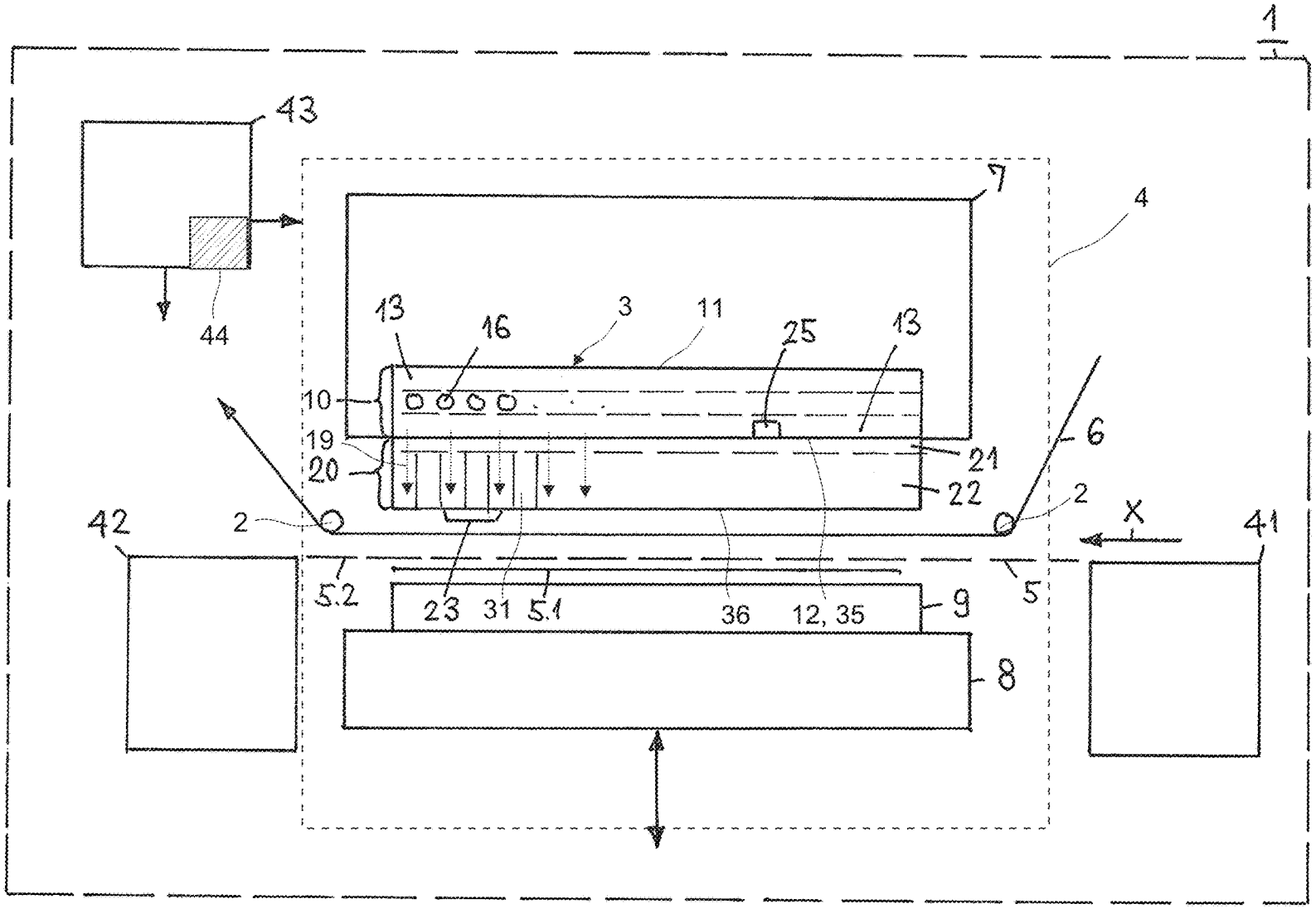
FIG. 1 a cross-sectional view of a flat bed embossing machine with an induction heating appliance.

Certain features, for example features which are not essential to the invention are not represented in the drawings, for a better understanding of the invention. The described embodiment examples are exemplary of the subject-matter of the invention or serve for its explanation and have no limiting effect.

FIG. 1 shows a schematic representation of a flat bed embossing machine 1.

The machine (press) 1 comprises a flat bed press 4 with a printing table 8 and with a press head 7. The printing table 8 comprises a back-pressure plate 9.

A base plate 10 of an induction heating appliance 3 is arranged on the press head 7. The base plate 10 comprises a plate rear side 11 with a first support surface, and a tool plate side 12 which lies opposite the plate rear side 11 and which has a second support surface. The base plate 10 bears with the support surface of the plate rear side 11 on a fastening component of the press head 7 in an extensive (surfaced) manner and is mechanically connected to this.

The press head 7 moreover comprises a tool plate 20. This forms a plate rear side 35 with a first support surface, and a tool side 36 which lies opposite the plate rear side 35 and which has tool receiving surface (see also FIG. 2).

On operation, the tool plate 20 bears with the support surface of the plate rear side 35 on the support surface of the tool plate side 12 of the base plate 10. The tool plate 20 is thereby releasably fastened to the press head 7.

Embossing tools 23 are releasably fastened on the tool side 36 of the tool plate 20.

The tool plate 20 is designed as a honeycomb mount and for fastening the embossing tools comprises a honeycomb region 22 which forms a fastening zone, with a plurality of blind holes 31 which run transversely to the support surface. The blind holes 31 are delimited to the plate rear side 35 by a continuous base region 21.

Likewise schematically represented is a feed device 41 for the flat material 5 as well as a leading-away device 42 for the flat material 5

If the flat bed embossing machine 1 is designed as a sheet-fed machine, then the flat material 5 is present as a sheet 5.1. In this case, the feed device 41 comprises a feeder and the leading-away device 42 a delivery means.

If the flat bed embossing machine 1 is designed as a continuous web machine, then the flat material 5 is present as a continuous web 5.1. The feed device 41 in this case comprises a winding-off unit and the leading-away device 42 a winding-up unit.

Both variants are schematically represented in FIG. 1.

The flat bed embossing machine 1 moreover comprises a foil web guide 2 for guiding an embossing foil web 6 through the embossing region between the tool plate 20 and the back-pressure plate 9.

The flat bed embossing machine 1 moreover comprises a machine control 43 for the control of the flat bed press 4 as well as of the foil web guide 2 and of the feed device and leading-away device 41, 42.

The heating appliance 3 moreover comprises a regulating device 44 for the regulation of the temperature of the tool plate 20. Here, the regulating device 44 is integrated into the machine control 43.

For carrying out an embossing procedure, the embossing foil and the flat material 5 are inserted between the tool plate 20 and the back-pressure plate 9 and are positioned. The embossing foil can likewise be inserted in the process direction X or counter to the process direction X whilst the flat material 5 is introduced in the process direction X.

The flat material 5 lies on the back-pressure plate 9. The embossing foil 6 is arranged between the flat material 5 and the tool plate 20.

The back-pressure plate 9 is pressed onto the stationary tool plate 20 amid the application of an embossing pressure, by way of moving up the printing table 8 (see arrows). The printing table 8 with the back-pressure plate 9 is moved downwards again after completion of the embossing procedure. The printing table 8 therefore executes an embossing stroke or lift H. The embossed flat material 5 is subsequently moved further in the process direction X.

Figure 3:
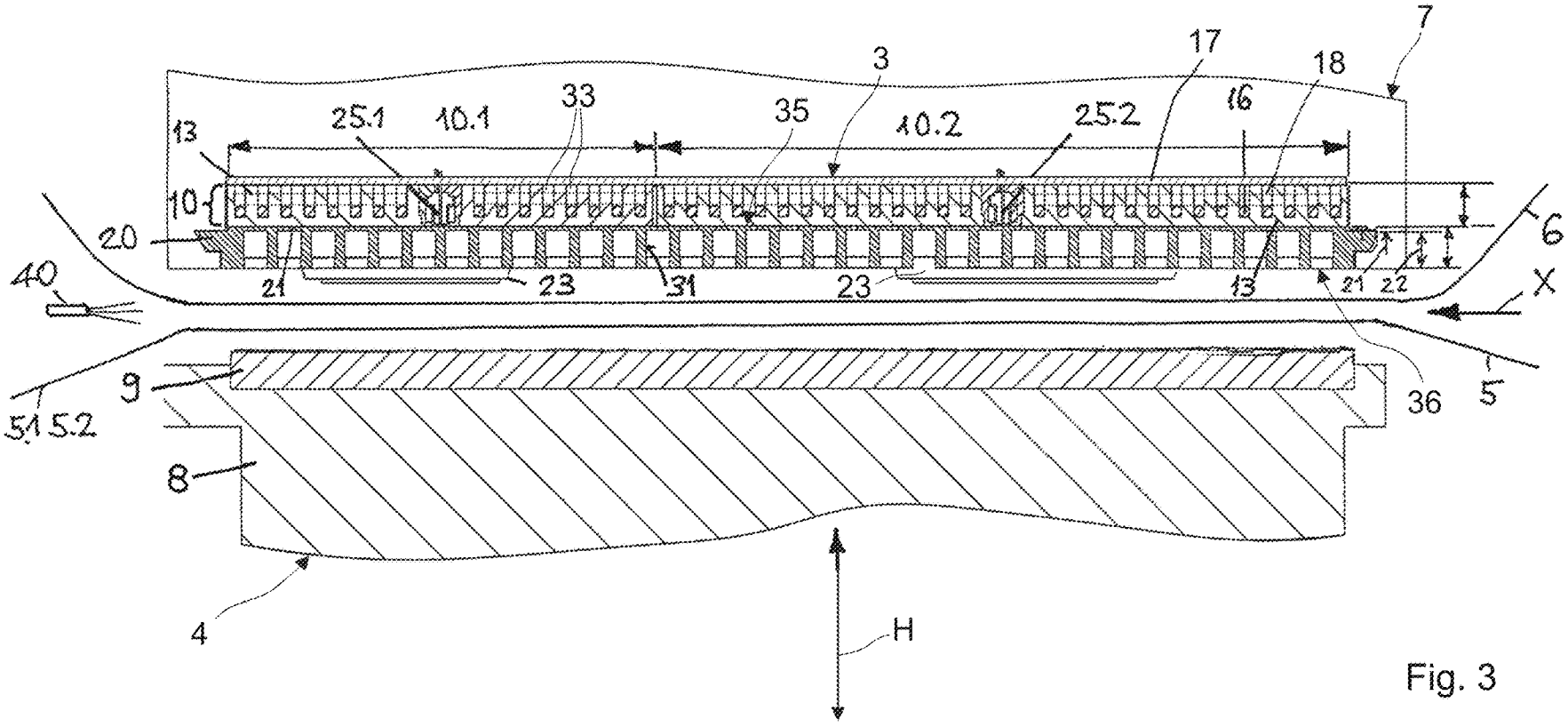
FIG. 3 a cross-section view of the embossing region.
Figure 6:
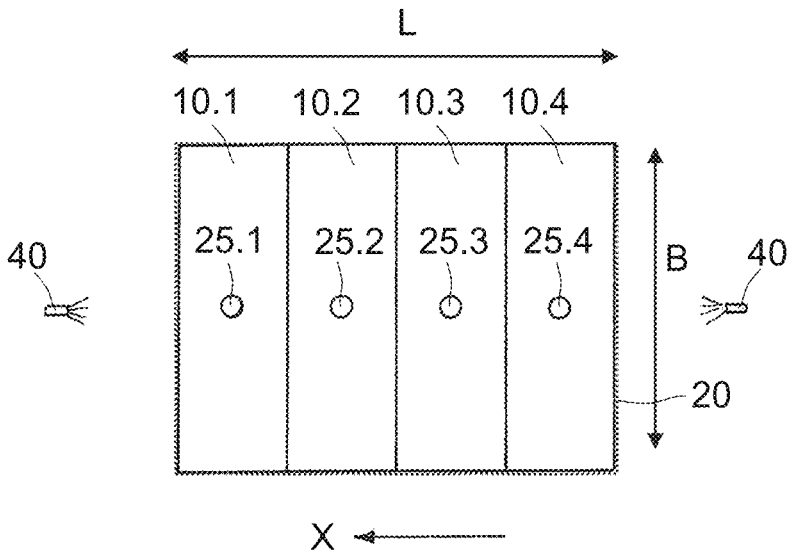
FIG. 6 a plan view of an arrangement of four adjacent heating modules, each with a base plate for a tool plate of a continuous web machine.
Figure 7:
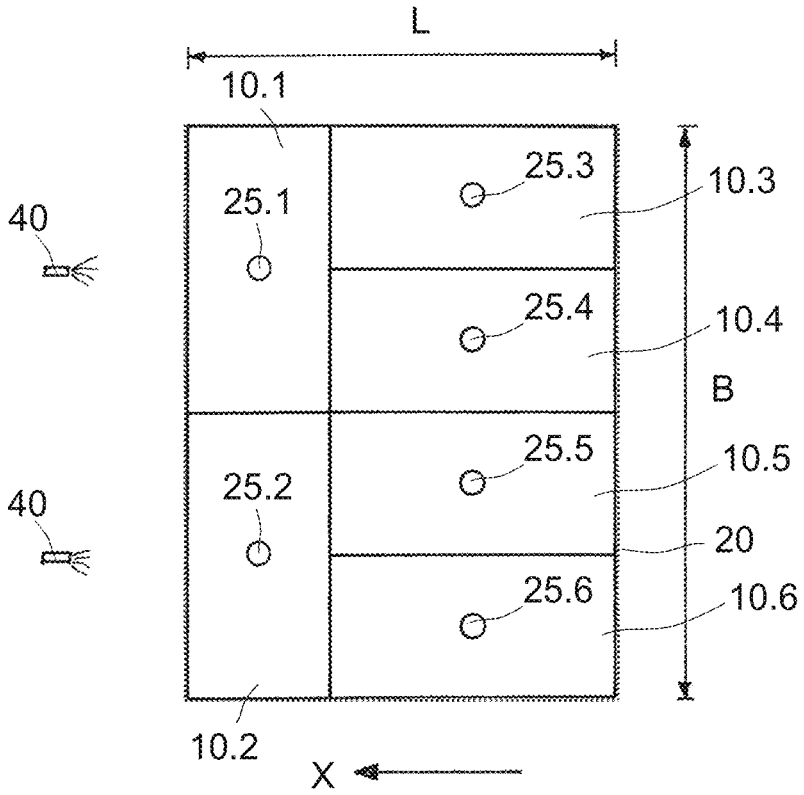
FIG. 7 a plan view of an arrangement of six adjacent heating modules, each with a base plate for a tool plate of a sheet-fed machine.

A compressed air device 40 for producing a blowing airflow for the purpose of separating the embossed flat material 5 from the foil web 6 is arranged at the exit side of the embossing region considered in the process direction X (see FIGS. 3, 6 and 7). The compressed air device 40 e.g. is a blower.

However, the embossing tools 23 need to be heated to an embossing temperature prior to carrying out the embossing procedure.

Figure 4:
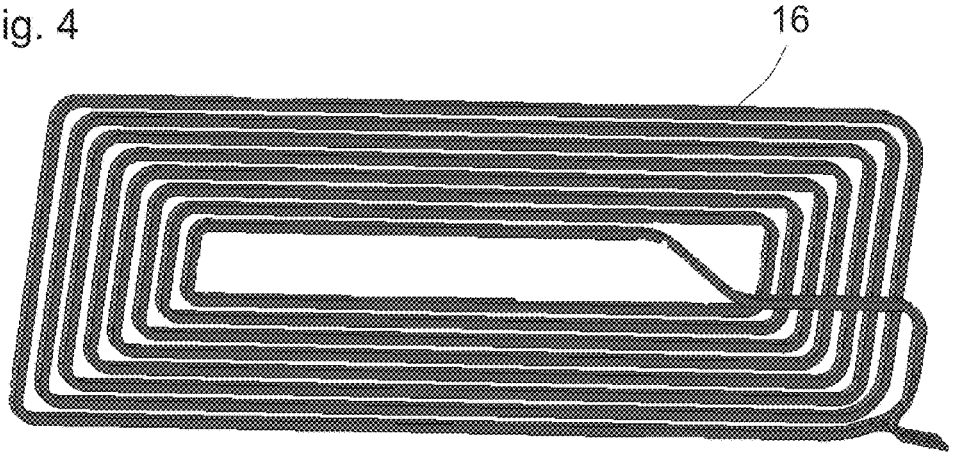
FIG. 4 a perspective representation of an inductor as a would electrical conductor.

For this, the base plate 10 is part of an induction heating 3. An inductor 16 in the embodiment of a flat coil (see also FIG. 4) is recessed into the base plate 10 and is arranged between the tool plate side 12 and the plate rear side 11. For this, the inductor 16 is inserted from the plate rear side 11 into slot openings 33 in the base plate 10 and is e.g. bonded in this with an adhesive or moulded into it with a moulding material. The slot openings 33 are accordingly open to the plate rear side 11. The flat coil 16 is arranged in a planar-parallel manner to the support surface on the tool plate side 12.

Figure 5A:
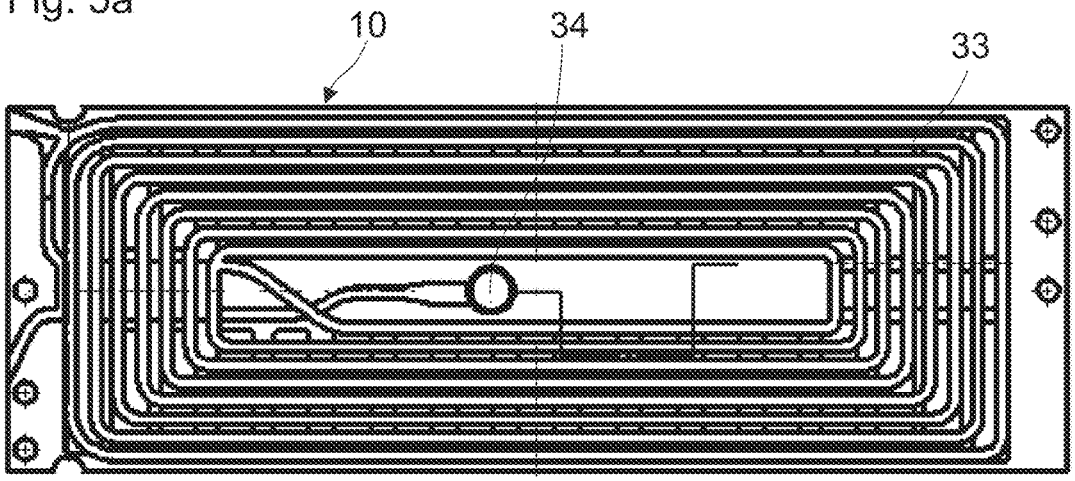
FIG. 5*a* a plan view of the base plate for receiving an inductor according to FIG. 4.

FIG. 5*a* shows a plan view of the base plate 10 towards the plate rear side 11 for this. Amongst other things, the plate rear side 11 shows the slot openings 33 for the flat coil 16 as well as a through-opening 34 for the sensor unit 26 which is yet described further below.

The carrier material 13 of the base plate 10 is a plastic which is reinforced with glass fibres and accordingly is not electrically conductive, but is permeable to the produced magnetic alternating field 19.

For starting operating of the induction heating appliance 3, the inductor 16 is now fed with an alternating current by way of a power unit (not shown). A magnetic alternating field 19 is now produced due to the design and arrangement of the inductor 16 and this alternating field penetrates into the base region 21 of the tool plate 20 and inductively heats this.

Moreover, ferrimagnetic bodies 18 are arranged in the base plate 10, between the support surface of the plate rear side 11 and the inductor 16. The ferrimagnetic bodies 18 are recessed in the base plate 10 from the plate rear side 11. The ferrimagnetic bodies 18 serve for deflecting the magnetic alternating field towards the tool plate 20 and thus also for shielding the remaining press head 7 at the plate rear side 11.

Figure 5B:
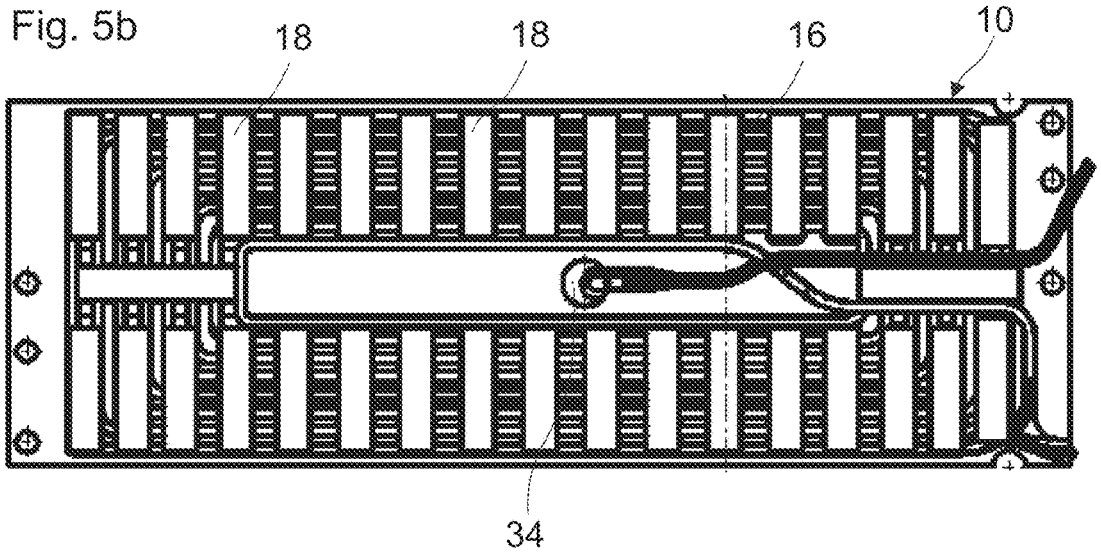
FIG. 5*b* the base plate according to FIG. 5*a* with an inductor and with ferrimagnetic elements.

For this, FIG. 5*b* shows the plan view of a heating module with a viewed direction onto the rear side 11 of the base plate 10. The heating module comprises the flat coil 16 which is inserted into the slot openings 33 of the base plate, as well as the ferrimagnetic bodies 18 which are mentioned above and which are likewise arranged in deepenings of the base plate 10 between the flat coil 16 and the support surface of the plate rear side 11.

Figure 2:
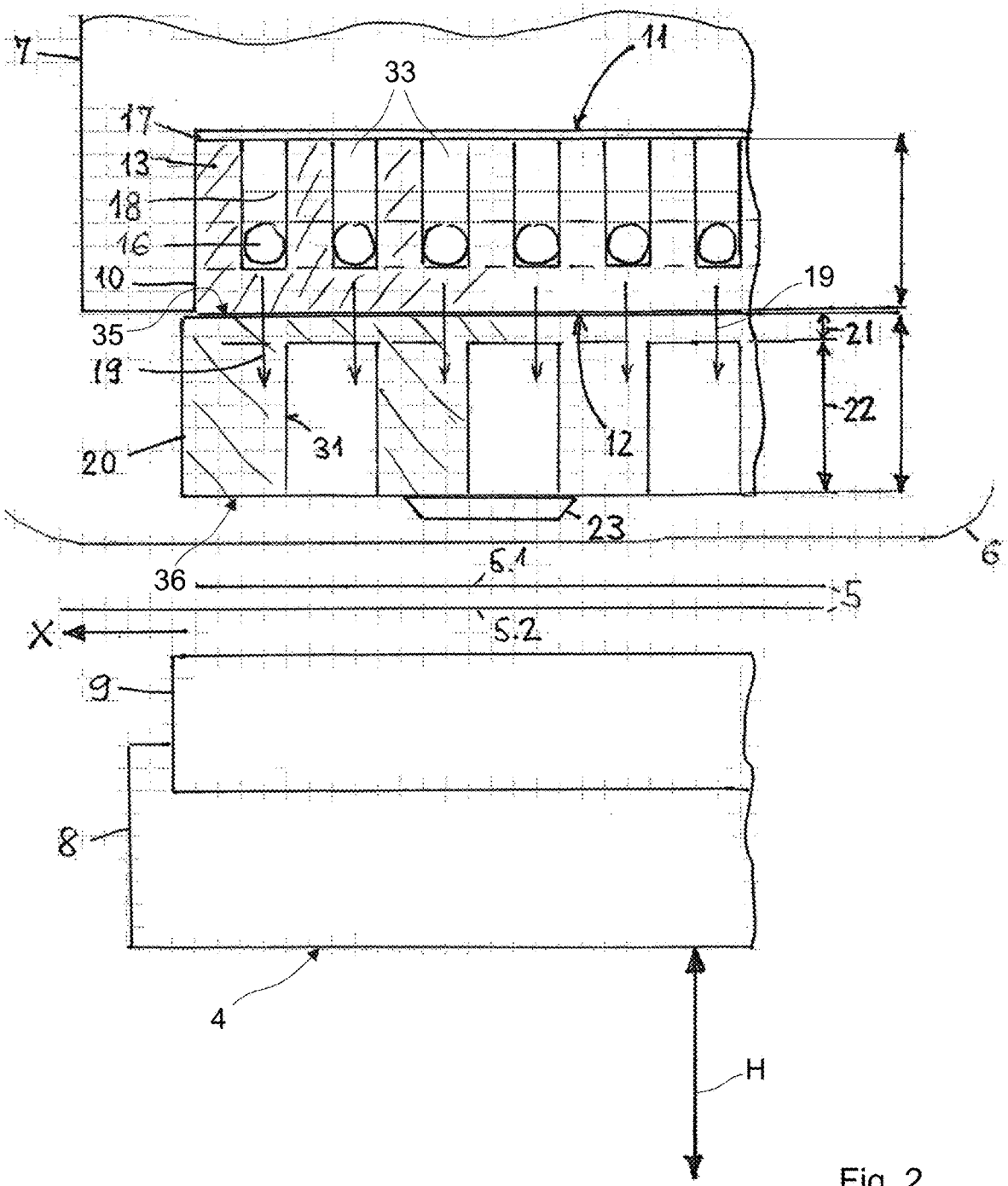
FIG. 2 an enlarged detail of FIG. 1 from the region of the induction heating appliance.

Moreover, a shielding element 17 in the form of an aluminium sheet with a thickness of e.g. 0.2 mm bears on the rear side 11 of the base plate 10 (FIG. 2). The shielding element 17 serves for shielding the remaining press head 7 from the magnetic alternating field. An inductive heating of the remaining press head 7 is to be prevented by way of this. The shielding element 17 can otherwise likewise be part of the heating module.

The thermal energy which is inductively produced in the base region 21 of the tool plate 20 is now led towards the tool side 36 by way of thermal conduction and from there is led into the embossing tools 23. The thermal conduction within the continuous base region 21 parallel to the support surface of the plate rear side simultaneously ensures a homogeneous temperature of the entire extension of the tool plate 20.

FIG. 6 shows a particular embodiment of an induction heating appliance for a continuous web machine with four heating modules, each with a base plate 10.1 to 10.4 and with an inductor. The four heating modules are arranged successively in the process direction X on the rear side of the tool plate 20. The tool plate 20 is yet drawn in a dotted manner in FIG. 6 for the sake of completeness. The tool plate 20 has a length L in the process direction X and a width B transverse to the process direction X. Likewise drawn are a compressed air device 40 which is arranged at the entry side and outlet exit side, for producing a blowing airflow.

The division of the heating zone of the tool plate 20 into several part-zones which are each heated by a heating module permits the individual heating of individual part-zones of the tool plate 20.

FIG. 7 shows an embodiment of a sheet-fed machine with in total six heating modules 10.1 to 10.6. Four heating modules 10.3 to 10.6 are arranged next to one another transversely to the process direction X at the inlet side. Two further heating modules 10.3 to 10.6 are arranged next to one another transversely to the process direction X at the outlet side.

Likewise drawn are two compressed air devices 40 which are arranged at the outlet side and are for producing a blowing airflow.

If for example, as is represented in FIGS. 6 and 7, blowing air is blown in at the outlet side and possibly also at the inlet side of the embossing region by way of a compressed air device 40, then the inlet-side or outlet-side part-zone cools down more rapidly than the middle part-zones of the heating zone.

The outlet-side and possibly also the inlet-side part-zone can now be heated to a greater extent than the middle part-zones thanks to the present arrangement of several heating modules according to FIGS. 6 and 7. A homogeneous temperature of the tool plate 20 over all part-zones can be ensured by way of this, despite the differently large heat losses over the surface extension of the tool plate.

Each heating module comprises a temperature sensor 25.1 to 25.4 (FIG. 6) or 25.1 to 25.6 (FIG. 7), with which the temperature in the respective part-zone can be measured, in order to detect the different temperatures in the individual part-zones.

FIG. 3 shows a schematic cross-sectional view through the embossing region of a flat bed embossing machine with a tool plate 20 and, arranged next to one another on the rear side of this tool plate, two heating modules each with a base plate 10.1, 10.2. The heating modules can be individually operated, so that considered in the process direction X, a front and rearward part-zone of the heating zone formed by the base region 21 are heatable independently of one another.

Figure 8A:
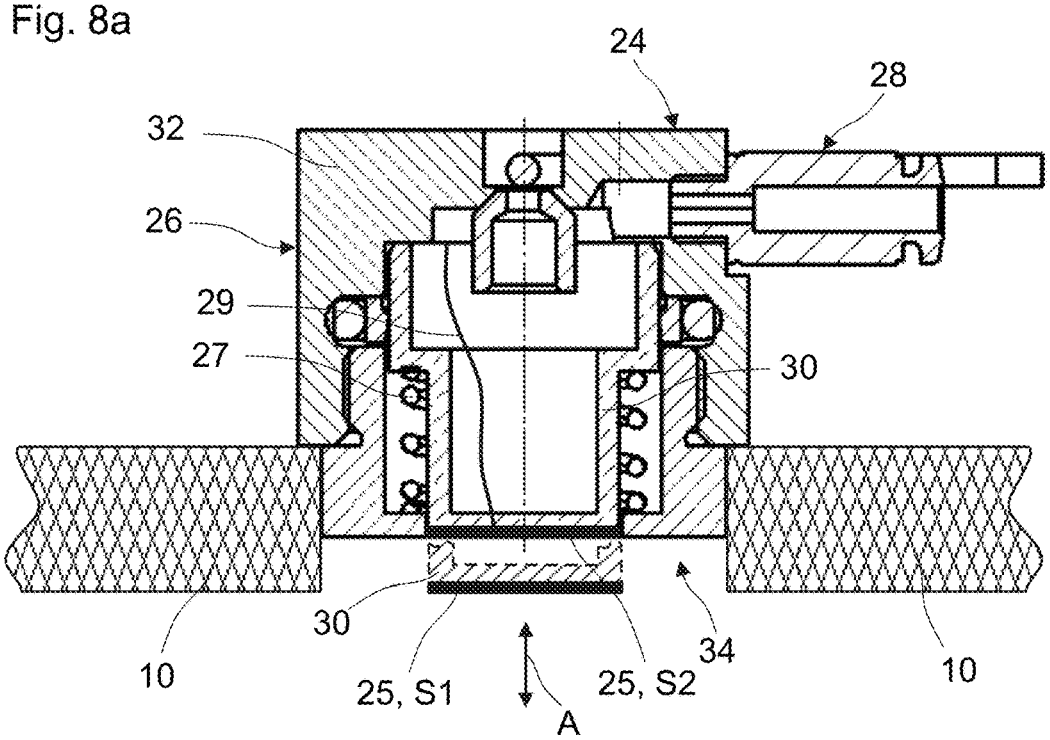
FIG. 8*a* a cross-sectional view of a first embodiment of a temperature measuring device.
Figure 8B:
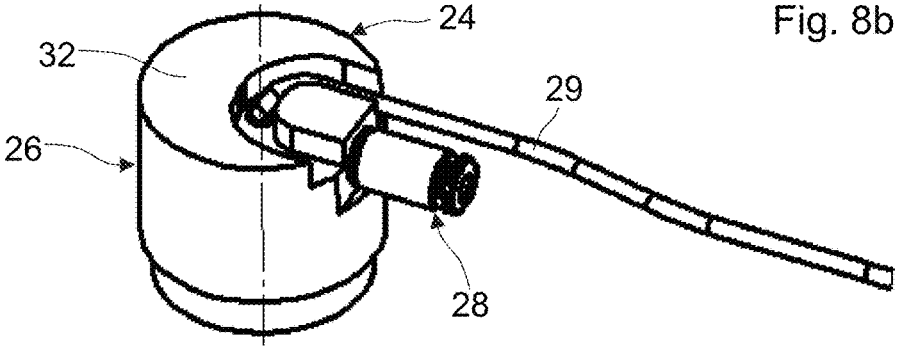
FIG. 8*b* a perspective view of the temperature measuring device according to FIG. 8*a;*

The respective heating module each comprises a temperature measuring device with a temperature sensor 25.1, 25.2 (see also FIG. 8*a*, 8*b*), so that the temperature of the base region 21 of the tool plate 20 in the part-zones and consequently the temperature of the embossing tools 23 can be regulated via the temperature regulation device 44 (see also FIG. 8*a*, 8*b*).

FIGS. 8*a* and 8*b* show a first embodiment of a temperature measuring device 24 with a sensor unit 26. The sensor unit 26 comprises a temperature sensor 25 which is attached to one end of a movable sensor carrier 30 and is directed towards the support surface of the base plate 10. The sensor carrier 30 is present as a sleeve and forms the moving part of the sensor unit 26. The sensor unit 26 moreover comprises a housing 32, in which the sensor carrier 30 together with the temperature sensor 25 is displaceably guided along a movement axis between a measuring position S1 and a configuring position S2 by way of a sliding guide. A tension spring 27 acts as a restoring element and leads the sensor carrier 30 together with the temperature sensor 25 back into the configuring position S2 or holds it in this.

The above-mentioned elements together form a movement mechanism for displacing the sensor carrier 30 with the temperature sensor 25.

The sensor unit 26 is recessed in a through-opening 34 in the base plate 10, wherein the temperature sensor 25 is directed towards the tool plate side 12.

The movement mechanism is driven by a pneumatic drive 28. A gas pressure is hence built up in the cavity of the sensor carrier 30 via a pneumatic conduit. If the pressing force which is exerted upon the sleeve by the gas pressure exceeds the restoring force of the tension spring 27, then the sensor carrier 30 is moved out of the configuring position S2 into the measuring position S1.

If the gas pressure is relieved again, then the tension spring 27 on account of its restoring force pulls the sensor carrier 30 and consequently the temperature sensor 25 back again into the configuring position S2 as soon as the restoring force exceeds the gas pressure force.

The control of the pneumatic drive 28 and thus of the position of the temperature sensor is effected e.g. via the machine control 43.

A sensor lead 59 which is led from the temperature sensor 25 through the cavity of the sensor carrier 30 to the outside is provided for transmitting the sensor measuring data to the temperature regulation device 44.

In particular, the temperature measuring device which is described above is designed for flat bed embossing machines, concerning which the tool plate is led up to the base plate with a lateral movement component on assembly after the (re-)configuration, so that the tool plate could damage a protruding temperature sensor on assembly, e.g. by way of shearing it off.

Figure 9:
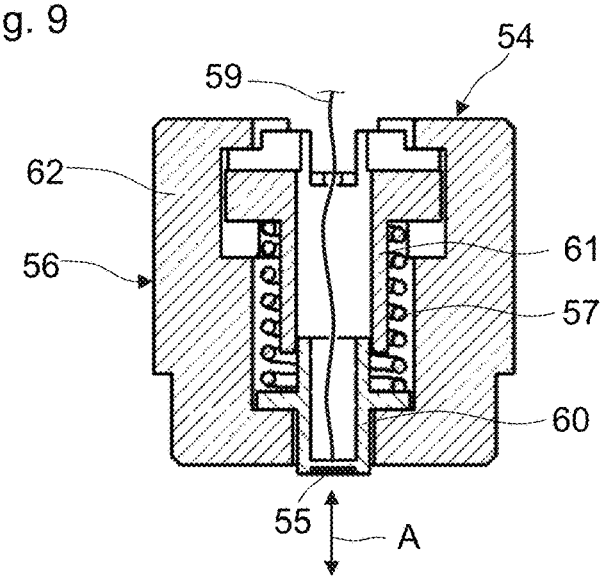
FIG. 9 a cross-sectional view of a second embodiment of a temperature measuring device.

The second embodiment of a temperature measuring device which is shown in FIG. 9 differs from a first embodiment according to FIGS. 8*a* and 8*b* in that this does not comprise a pneumatic device for the controlled moving of the sensor carrier in the base plate.

The temperature measuring device 54 comprises a sensor unit 56. The sensor unit 56 comprises a temperature sensor 55 which is attached to the end of a movable sensor carrier 60 and is directed towards the support surface on the tool plate side of the base plate. The sensor carrier 60 is present in the form of a sleeve and forms the moving part of the sensor unit 56. The sensor unit 56 moreover comprises a housing 62, in which the moving sensor carrier 60 with the temperature sensor 55 is movably guided along a movement axis A via a sliding guide.

The sensor unit 56 is recessed in a through-opening in the base plate, wherein the temperature sensor 55 is directed towards the tool plate side.

The sliding guide is formed by a guide sleeve 61 which is arranged in the housing 62 in a stationary manner. For this, the movable sensor carrier 60 in particular forms a cylinder-shaped sliding section, via which the sensor carrier 60 is slidingly guided along an in particular cylinder-shaped sliding section of the sliding sleeve 61. In particular, the sliding sections are shaped in a circularly cylindrical manner. The sliding section of the movable sensor carrier 60 thereby engages over the sliding section of the sliding sleeve 61 or—as is shown in FIG. 9—engages into this.

The sliding sections of the two sleeves 60, 61 are encompassed by a compression spring 57 in the form of a helical spring. The compression spring 57 bears with one end on a stop on the sensor carrier 60 and with another end on a stop on the guide sleeve 61.

The compression spring 57 serves as a restoring element which moves the pressure-relieved sensor carrier 60 together with the temperature sensor 55 into the configuring position and holds it in this. In the configuring position, the end-section of the sensor sleeve 60 with the temperature sensor 55 projects beyond the support surface of the base plate, e.g. by about 0.5 mm (see FIG. 9).

The temperature measuring device which is described above is particularly suitable for flat bed embossing machines, concerning which the tool plate is led onto the base plate perpendicularly to the support surface of the base plate on assembly after the (re-)configuration, so that the tool plate cannot damage a protruding temperature sensor on assembly, but in contrast presses this back into the base plate. A sufficient pressing pressure of the temperature sensor onto the tool plate is ensured in the operational position by way of this, for the purpose of forming a measuring contact.

A sensor lead 59 which is led from the temperature sensor 55 through the cavity of the sensor carrier 60 and of the sliding guide 61 to the outside is provided for transmitting the sensor measurement data to the temperature regulating device 44.

The invention claimed is:

1. A flat bed embossing machine comprising:

at least one embossing tool;

an inductively heatable tool plate with a tool side on which the at least one embossing tool is arranged and with a tool plate rear side which lies opposite the tool side;

at least one base plate with a tool plate side which faces the tool plate rear side and with a base plate rear side which lies opposite the tool plate side, for transmitting an embossing force which is exerted upon the tool plate, between the tool plate side and the base plate rear side; and an induction heating appliance with at least one inductor for heating the at least one embossing tool, wherein the heating appliance is arranged on a side which is facing the tool plate rear side, and wherein the at least one inductor is designed and is arranged between the tool plate side and the base plate rear side of the at least one base plate and is recessed into the at least one base plate such that the heating appliance by means of the inductor produces a magnetic alternating field which at the tool plate side of the at least one base plate reaches beyond the at least one base plate for the inductive heating of the tool plate which is arranged beyond the tool plate side of the at least one base plate and outside the at least one base plate.

2. A flat bed embossing machine according to claim 1, wherein the at least one inductor and the at least one base plate together form part of a heating module.

3. A flat bed embossing machine according to claim 1, wherein the at least one inductor is designed as a wound electrical conductor with curvatures which are arranged in a plane parallel to the tool plate side.

4. A flat bed embossing machine according claim 1, wherein field conducting elements with ferrimagnetic characteristics are arranged between the at least one inductor and the base plate rear side.

5. A flat bed embossing machine according to claim 4, wherein the field conducting elements are recessed into the at least one base plate.

6. A flat bed embossing machine according to claim 1, wherein an extensive shielding element consisting of or comprising an electrically conductive material is arranged on the base plate rear side, wherein the shielding element shields the machine in a region facing the base plate rear side at least partly from the magnetic alternating field.

7. A flat bed embossing machine according to claim 1, wherein the at least one base plate consists of a carrier material which is electrically non-conductive.

8. A flat bed embossing machine according to claim 7, wherein the carrier material of the at least one base plate is a fiber-reinforced plastic.

9. A flat bed embossing machine according to claim 1, wherein the tool plate forms a heating zone which is inductively heatable by the at least one induction heating appliance.

10. A flat bed embossing machine according to claim 9, wherein the tool plate forms a continuous base region in a region facing of the tool plate rear side, and the continuous base region is part of the heating zone.

11. A flat bed embossing machine according to claim 10, wherein the tool plate comprises a multitude of recesses which are open to the tool side and which end at the continuous base region of the tool plate rear side.

12. A flat bed embossing machine according to claim 1, wherein the flat bed embossing machine comprises a plurality of individually operable heating modules each with one of the at least one base plate and with one of the at least one inductor which are arranged next to one another over the tool plate rear side, each of the heating modules designed for individually heating a part-zone of the tool plate.

13. A flat bed embossing machine according to claim 1, wherein the induction heating appliance comprises a temperature measuring device for determining a temperature of the tool plate.

14. A flat bed embossing machine according to claim 13, wherein the temperature measuring device comprises at least one temperature sensor for measuring at least one temperature of the tool plate.

15. A flat bed embossing machine according to claim 14, wherein the temperature measuring device comprises a movement mechanism, by way of which the at least one temperature sensor is fastened to the at least one base plate in a movable manner relative to the at least one base plate and is movable toward the tool plate rear side and in the opposite direction of the moving direction toward the tool plate rear side.

16. A flat bed embossing machine according to claim 15, wherein the at least one temperature sensor, by way of the movement mechanism, is movable between a measuring position, in which the at least one temperature sensor forms a measuring contact with the tool plate rear side, and a configuring position in which the at least one temperature sensor is not in contact with the tool plate rear side.

17. A flat bed embossing machine according to claim 13, characterised by a control device for controlling the temperature of the tool plate via the induction heating appliance on the basis of temperature values which are detected by the temperature measuring device.

* * * * *